US007244111B2

(12) United States Patent
Suter et al.

(10) Patent No.: US 7,244,111 B2
(45) Date of Patent: Jul. 17, 2007

(54) COMPRESSOR APPARATUS AND METHOD FOR THE OPERATION OF THE SAME

(75) Inventors: Roger Suter, Zurich (CH); George Kleynhans, Buelach (CH); Peter Ortmann, Schaffhausen (CH)

(73) Assignee: MAN Turbomuschinen AG Schweiz, Zurich (CH)

( * ) Notice: Subject to any disclaimer, the term of this patent is extended or adjusted under 35 U.S.C. 154(b) by 117 days.

(21) Appl. No.: 10/883,744

(22) Filed: Jul. 6, 2004

(65) Prior Publication Data

US 2005/0019170 A1 Jan. 27, 2005

(30) Foreign Application Priority Data

Jul. 5, 2003 (EP) ..... 03405502

(51) Int. Cl.
*F04D 25/06* (2006.01)
*F04D 29/04* (2006.01)

(52) U.S. Cl. ..... 417/423.1; 417/423.12

(58) Field of Classification Search ..... 417/366, 417/369, 370, 423.1, 423.7, 423.12
See application file for complete search history.

(56) References Cited

U.S. PATENT DOCUMENTS 4,616,980 A * 10/1986 Carpenter ..... 417/369
5,698,917 A 12/1997 Shultz
6,390,789 B1 * 5/2002 Grob et al. ..... 417/369
6,464,469 B1 10/2002 Grob et al.

FOREIGN PATENT DOCUMENTS

WO WO 02/099286 12/2002

OTHER PUBLICATIONS

Search Report from EP 03 40 5502.

* cited by examiner

*Primary Examiner*—Michael Koczo, Jr.
(74) *Attorney, Agent, or Firm*—Pearl Cohen Zedek Latzer, LLP

(57) ABSTRACT

The compressor apparatus comprises a radial compressor (35) for the compression of a gas and also an electric motor (31) for driving the radial compressor (35), wherein the radial compressor (35) and the electric motor (31) are arranged in a pressure housing (1) which is provided with a gas inlet duct (2) and also a gas outlet duct (3), and also comprises an encapsulated apparatus (4) arranged in the pressure housing (1), the inner space of the encapsulated apparatus being fluid conductingly connected to a pressure reducing apparatus (37).

10 Claims, 4 Drawing Sheets

COMPRESSOR APPARATUS AND METHOD FOR THE OPERATION OF THE SAME

FIELD OF THE INVENTION

The invention relates to a compressor apparatus and to a method for operating a compressor apparatus.

BACKGROUND OF THE INVENTION

It is known, for the pumping and/or compressing of gases to use a compressor apparatus comprising a radial compressor and also an electric motor which drives it. If the compressor apparatus is operated at a higher process pressure then it is additionally known to arrange the compressor apparatus within a pressure housing, in particular a common pressure housing, with the pressure housing being provided with gas inlet and gas outlet ducts.

A disadvantage of such a compressor apparatus operated in a higher process pressure is the fact that these are less suitable for the compression of contaminated gases or gases with corrosive components, because certain components of the compressor apparatus are subjected to an increased wear.

SUMMARY OF THE INVENTION

It is the object of the present invention to provide compressor apparatus and also a method of operating a compressor apparatus which is in particular suitable for the pumping of contaminated and/or corrosive gases.

The object is in particular satisfied with a compressor apparatus comprising a radial compressor for the compression of a gas and also an electric motor for driving the radial compressor, wherein the radial compressor and the electric motor are arranged in a pressure housing which is provided with a gas inlet duct and also a gas outlet duct, and also comprising an encapsulated apparatus arranged in the pressure housing, the inner space of the encapsulated apparatus being fluid conductingly connected to a pressure reducing apparatus.

In a simple embodiment the pressure reducing apparatus is formed as a fluid conducting connection line to the space outside of the gas-tight pressure housing. The fluid is preferably a gas, could however also include a liquid or could consist essentially of a liquid.

The compressor apparatus of the invention has an encapsulated apparatus inside which sensitive components such as, for example, the stator of the electric motor are protected from the pumped gases, for example acidic gases with components of $H_2S$ and/or $CO_2$. The encapsulated apparatus includes an encapsulation, also termed "can" in English as well as components arranged therein. The encapsulation is preferably made gas-tight or approximately gas-tight As encapsulation preferably very thin, non-magnetizable metal sheets or fiber reinforced plastics are used, for example for the stator, which have a thickness in the millimeter range, for example a thickness in the range between 0.1 mm to 5 mm. It has surprisingly been shown that during operation of the compressor apparatus at a higher process pressure, for example when pumping a gas in the range between 1 and 150 bar, a pressure can build up within the encapsulated apparatus because the process gas penetrates or flows through crevices, gaps or by diffusion into the encapsulated apparatus. As a result of this gradual pressure build-up in the encapsulated apparatus an extremely dangerous operating state can arise, namely then when the pressure of the process gas is reduced very quickly, for example when the compressor apparatus is switched off. In such a situation it can transpire that the pressure in the encapsulated apparatus exceeds the pressure of the process gas which would have the consequence that the encapsulation will be damaged or destroyed, for example in that the extremely thin metal sheets bend, which could damage or destroy the compressor apparatus. In order to ensure a reliable operation of the compressor apparatus the encapsulated apparatus must therefore be at least mechanically protected. This takes place in that it is ensured that the pressure of the process gas is at least the same and preferably always higher than the pressure within the encapsulated apparatus. For this the inner space of the encapsulated apparatus is fluid conductingly connected to a pressure reducing apparatus, in particular via a fluid conducting connection line, with the space outside of the gas-tight pressure housing. In a simple embodiment this connection line opens directly into the atmosphere so that it is ensured that the pressure in the inner space of the encapsulated apparatus is always the same as the atmospheric pressure or does not rise substantially above the atmospheric pressure. In a further advantageous embodiment the said connection line opens into a controllable valve in order to control the pressure reduction, for example to the atmosphere, via the valve. With the aid of sensors and a regulating apparatus the pressure in the inner space of the encapsulated apparatus and the pressure in the inner space of the pressure housing can be measured and the valve can, for example, be actuated in such a way that the pressure in the inner space of the encapsulated apparatus always lies below the pressure of the process gas in the inner space of the pressure housing and for example has a constant pressure difference. In this operating mode it is for example possible for the pressure in the inner space of the encapsulated apparatus to amount to 100 bars without the risk of an explosion of the encapsulated apparatus existing on a reduction of the process pressure. If, for example, the compressor apparatus has to be switched off, a controlled decompression process can be carried out in that (for example), the process pressure is relieved with 20 bars/minute and the pressure in the encapsulated apparatus is likewise relieved at this rate via the pressure reduction apparatus, or at least in such a way that the pressure within the encapsulated apparatus is always lower than the process pressure.

A pressure increase in an encapsulated apparatus can arise, as well as through the penetration of gas, also by a temperature rise. If, for example, a magnetic radial bearing which is arranged in an encapsulated apparatus heats up during operation, then the pressure in the encapsulated apparatuses rises. If liquid, for example water, should be present in the encapsulated apparatus, then the internal pressure can also rise considerably through the temperature rise. The compression apparatus of the invention comprising a pressure reduction apparatus also ensures in this case that no mechanical damage to the encapsulated apparatus arises.

BRIEF DESCRIPTION OF THE FIGURES

The invention will be explained in the following in detail with reference to several embodiments. There are shown, in schematic form.

DETAILED DESCRIPTION OF THE INVENTION

Figure 1:
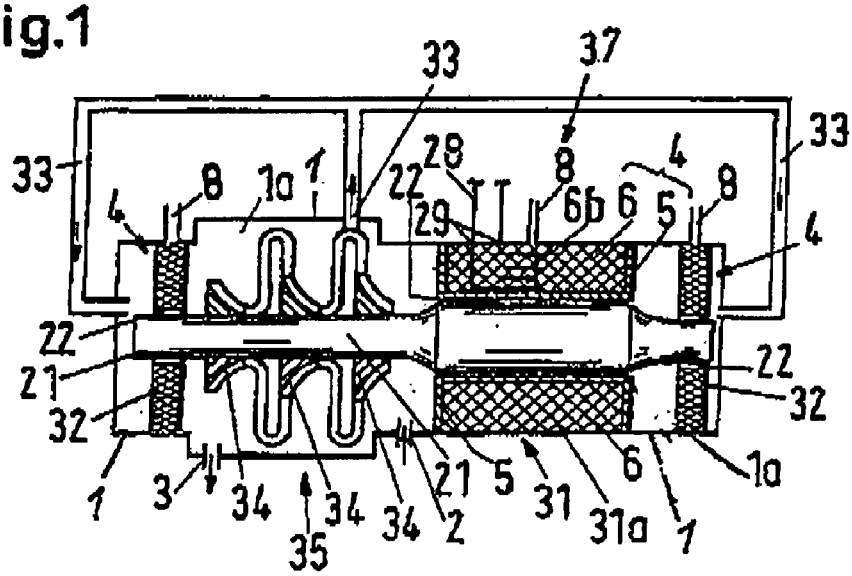
FIG. 1 a longitudinal section through a compressor apparatus which is arranged in a pressure housing.
Figure 2A:
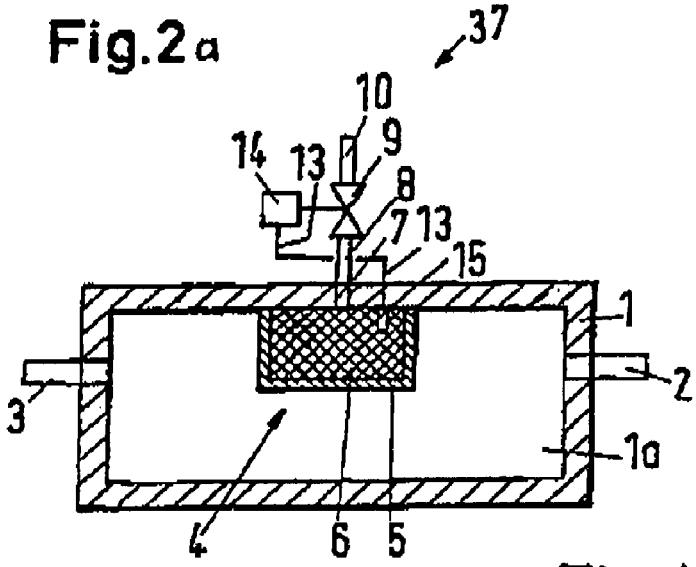
FIG. 2*a*–2*e* further embodiments of a longitudinal section through a pressure housing with an encapsulated apparatus.

FIG. 1 shows a compressor apparatus comprising a radial compressor 35 and also an electric motor 31 which are connected together via a common rotatable shaft 21, which are rotatably journalled by radial magnetic bearings 32 and which are arranged within a common pressure housing 1 with an inner space 1*a*. The pressure housing 1 is preferably gas-tight and has a gas inlet duct 2 and also a gas outlet duct 3 through which the pumped gas flows. In the inner space 1*a* of the pressure housing 1 a process pressure arises during the operation which lies between a gas inlet pressure in a gas inlet duct 2 and a gas outlet pressure in the gas outlet duct 3. A part of the gas compressed by the compressor blades 34 is fed via the lines 33 to the pressure housing 1 at the sides for the cooling of the compressor apparatus and flows inside the pressure housing 1 in the axial direction through the gas gap 22 of the magnetic bearing 32 and of the electric motor 31. Thus the process pressure which the pumped gas has is essentially present at the magnetic bearing 32 and at the stator 31*a*. For the protection of the stator 31*a*, i.e. of its schematically illustrated stator coils 6*b* from an aggressive gas, the stator is arranged in an inner space 6 of an encapsulated apparatus 4. The encapsulated apparatus 4 comprises the inner space 6 and also a sealing encapsulation 5. The inner space 6 of the encapsulated apparatus 4 forms a pressure-stable carrier structure which is, for example, formed by the stator coils 6*b* themselves or in that the stator coils 6*b* are, for example, potted in a pressure-tight medium. Electric cables 28 are provided via a cable lead-through 29 for the supply of energy to the stator coils 6*b*. The encapsulation 5, which preferably consists of a thin metal sheet, contacts the surface of the pressure-stable carrier structure. The metal sheet extending along the air gap 22 is non-magnetizable and has a thickness in the millimeter range. The laterally disposed metal sheets 5 which extend radially outwardly can have a greater thickness, for example more than 5 mm and can be of more stable design. The inner space 6 of the encapsulated apparatus 4 is bounded by the encapsulation 5 and also by the pressure housing 1 and is gas-tight or at least substantially gas-tight with respect to the process gas. The inner space 6 is connected via a fluid-conducting connection line 8 to the space outside of the pressure housing 1. Should an inner pressure build up in the inner space 6 in that the process gas present in the pressure space 1*a* penetrates through crevices, damaged points or diffusion via the encapsulation 5 into the inner space 6 then this pressure can be reduced in that the gas is directed via the pressure reduction apparatus 37, formed in this embodiment as a connection line 8, outwardly to the space outside of the pressure housing 1. In addition to or instead of the electric motor 31 other components such as the magnetic bearings 32 can also be arranged in the already explained encapsulated apparatus 4. In FIG. 1 neither the electric feed-line nor the electromagnetic coils of the radial magnetic bearing 32 are shown, which are, for example, potted in a medium. These encapsulated apparatuses 4 also have a pressure reduction apparatus 37, here shown as a connection line 8 in order to restrict the pressure in the encapsulated apparatus 4. The connection lines 8 shown in FIG. 1 open, for example, into the atmosphere.

FIG. 2*a* to 2*e* schematically illustrate further embodiments of pressure housing 1 including different embodiments of pressure reduction apparatuses 37 for the restriction of the pressure in the inner space 6 of the encapsulated apparatus 4. The pressure reduction apparatus 37 disclosed in FIG. 2*a* comprises a controllable, actuatable valve 9 in order to controllably reduce the pressure in the inner space 6. A simple possibility of detecting a penetration of process gas into the inner space 6 of the encapsulated apparatus 4 lies in providing a gas sensor 15 in the inner space 6, with the signal of the gas sensor being supplied via an electric lead 13 to a regulating apparatus 14. As soon as the gas sensor 15 detects the process gas it is to be expected that a pressure rise will take place in the inner space 6. The regulating apparatus 14 could, for example, trigger an alarm signal in order to manually open the valve 9 or the valve 9 could open automatically and discharge the pressure present at the connection line 8 via the line 10. A vent or flare could also be arranged after the line 10 in order to discharge gas standing under pressure into the atmosphere.

Figure 2B:
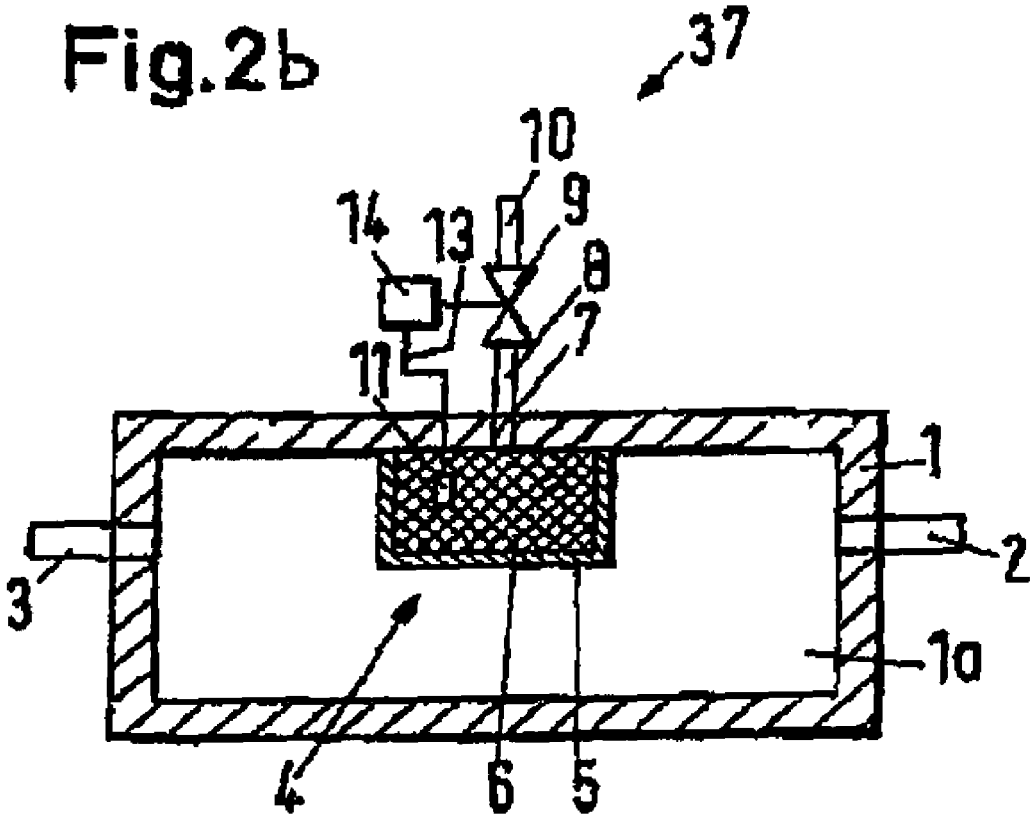
Figure 2C:
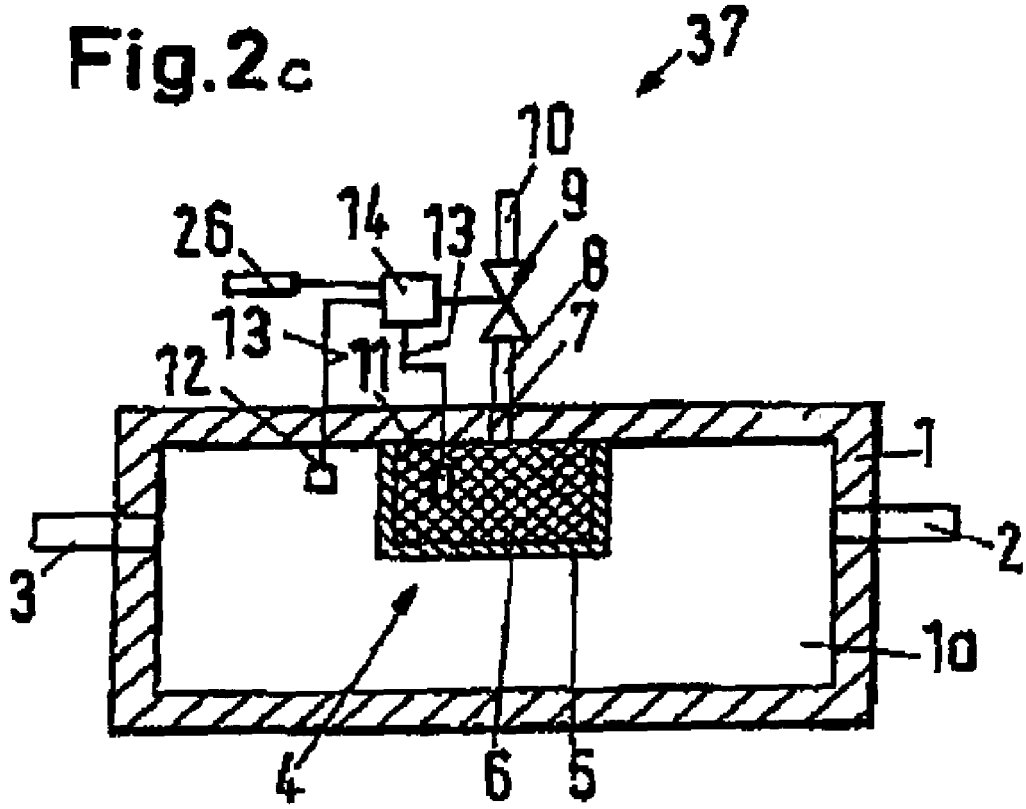
Figure 2D:
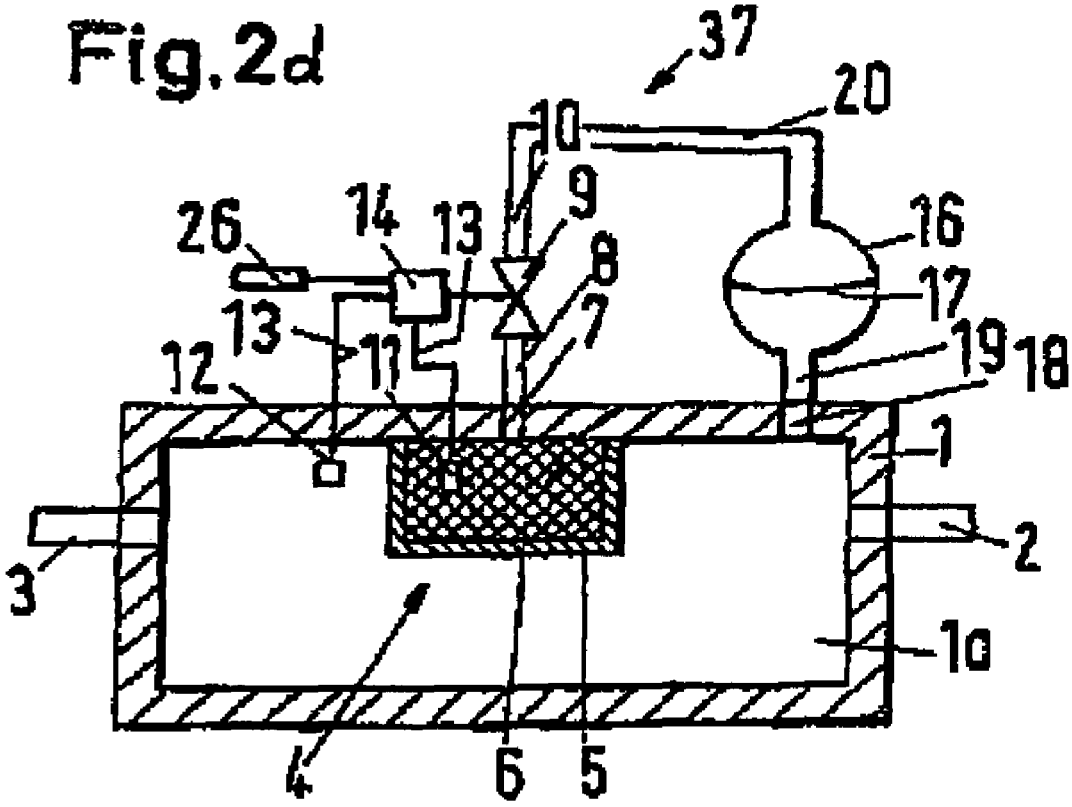

FIG. 2*b* discloses a further possibility of detecting a penetration of process gas into the inner space 6 of the encapsulated apparatus 4 consists of measuring the pressure in the inner space 6 with a sensor 11. FIG. 2*c* discloses a further embodiment in which the process pressure is additionally measured with a sensor 12 and/or the environmental pressure could be measured with a sensor 26 and fed to the regulating apparatus 14. The valve 9 is for example actuated by the regulating apparatus 14 in such a way that the pressure in the inner space 6 of the encapsulated apparatus 4 always lies below the process pressure present in the inner space 1*a* of the pressure housing 1, i.e. that the pressure in the inner space 6 is lower than in the inner space 1*a*. FIG. 2*d* discloses a further possibility of reducing the pressure in the inner space 6 of the encapsulated apparatus 4 by providing a buffer container 16 which is fluid-conductingly connectable to the inner space 6 via the pressure reduction device 37. The buffer container 16 could be arranged inside or outside of the pressure housing 1. In the example of FIG. 2 the pressure reduction apparatus 37 could include the connection lines 8 and 10, the valve 9 and also the line 20 and the buffer container 16 which are fluid conductingly connectable. The buffer container 16 has, moreover, a flexible and scaled membrane 17 and is connected via a line 19 and a break-through 18 with the inner space 1*a* of the pressure housing 1. With this pressure reduction apparatus 37 it can be ensured through corresponding control of the valve 9, that the pressure inside the inner space 6 does not raise above the pressure in the inner space 1*a* but has at the maximum the same value as in the inner space 1*a*. This is in particular important when the pressure in the inner space 1*a* sinks.

The valve 9 or also the entire pressure reduction apparatus 37 can be arranged within the pressure housing 1, or as shown in FIG. 2, essentially outside of the pressure housing 1.

Figure 2E:
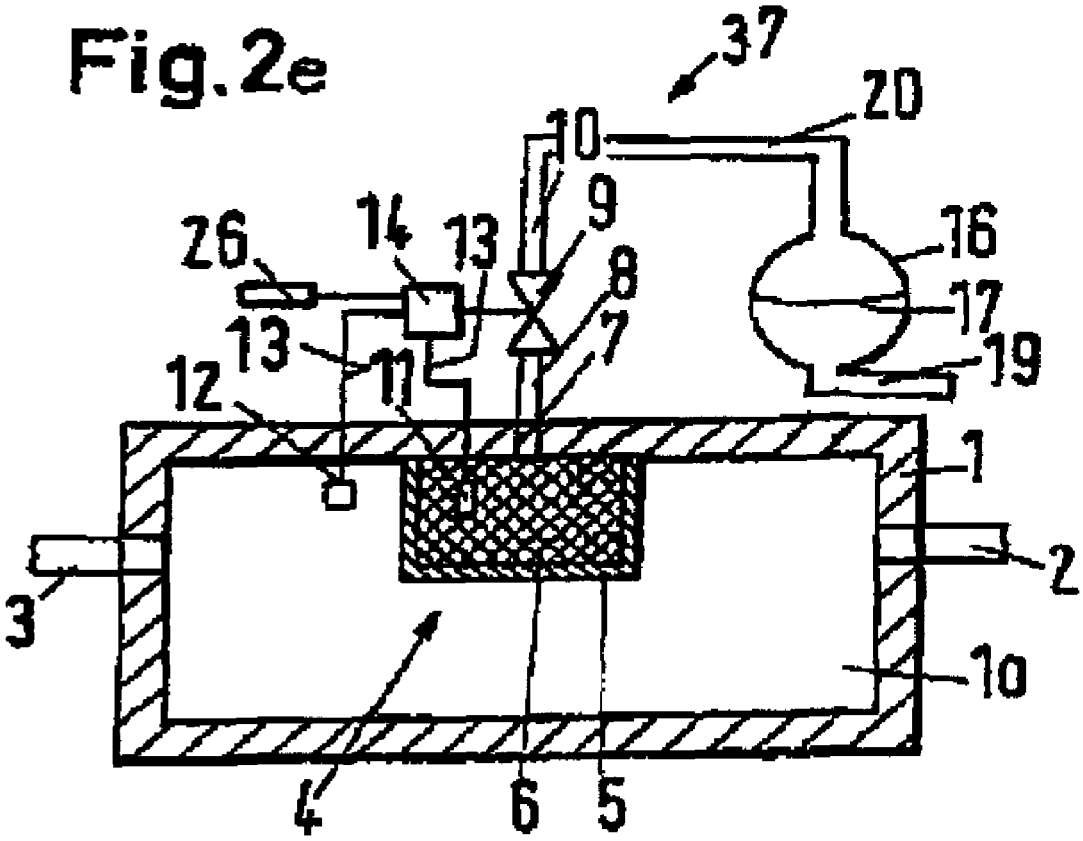

FIG. 2*e* discloses that the line 19 of the buffer container 16 could also form, in place of the connection into the pressure housing 1, an outlet into the environment, for example into the atmosphere or into the water surrounding the pressure housing 1. The pressure housing 1 and also the components arranged therein are in particular also suitable for operation under water.

Figure 3:
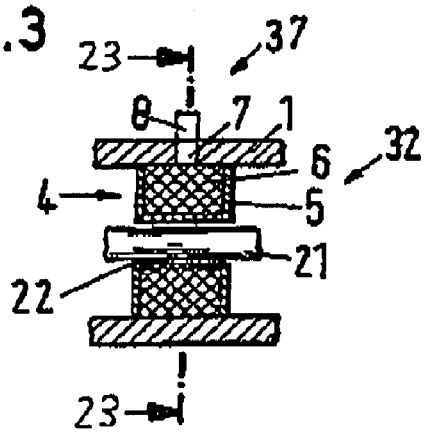
FIG. 3 a longitudinal section through an electromagnetic radial bearing.

FIG. 3 shows an encapsulated apparatus 4 which essentially includes a radial magnetic bearing 32 which is arranged in the inner space 6 and is surrounded by the encapsulation 5. The inner space 6 is connected via the pressure reduction apparatus 37 formed as a connection line 8 and the break-through 7 to the space outside of the pressure housing 1. The rotatable shaft 21 is held in contact-free manner by the radial magnetic bearing 32 with the formation of a gas gap 22.

Figure 4:
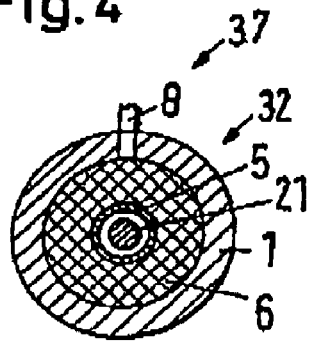
FIG. 4 a cross-section through the radial bearing shown in FIG. 3 along the section line 23—23.

FIG. 4 shows the radial magnetic bearing 32 described with FIG. 3 in a cross-sectional section line 23—23.

Figure 5:
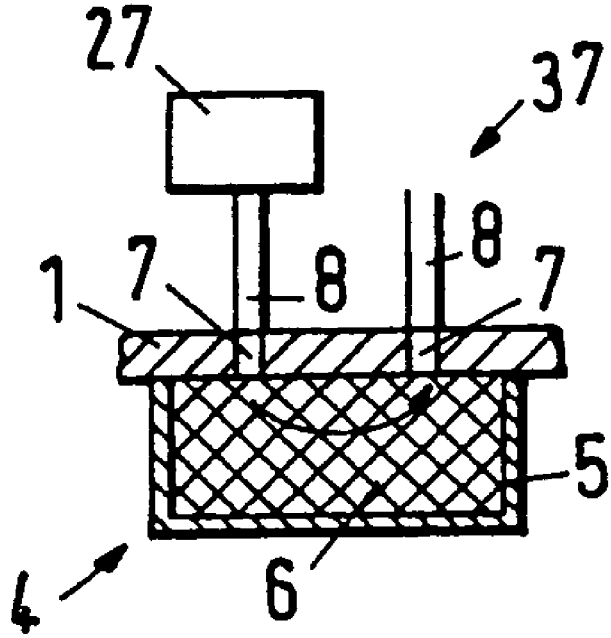
FIG. 5 a longitudinal section through an encapsulated apparatus.

FIG. 5 shows an encapsulated apparatus 4 with a pressure reduction apparatus 37 comprising two separate connection lines 8. With the aid of a supply container 27 a flushing gas, for example nitrogen, is supplied via a connection line 8 to the inner space 6 and is drawn off again via the second connection line 8 and for example discharged to the environment. The inner space 6 has non-illustrated fluid conducting channels which are preferably arranged such that flow takes place homogeneously through the inner space 6. This flushing serves to remove noxious chemical substances from the inner space 6 in order, for example, to protect the electrical coils and magnets located in the inner space 6 from chemical effects.

Figure 6:
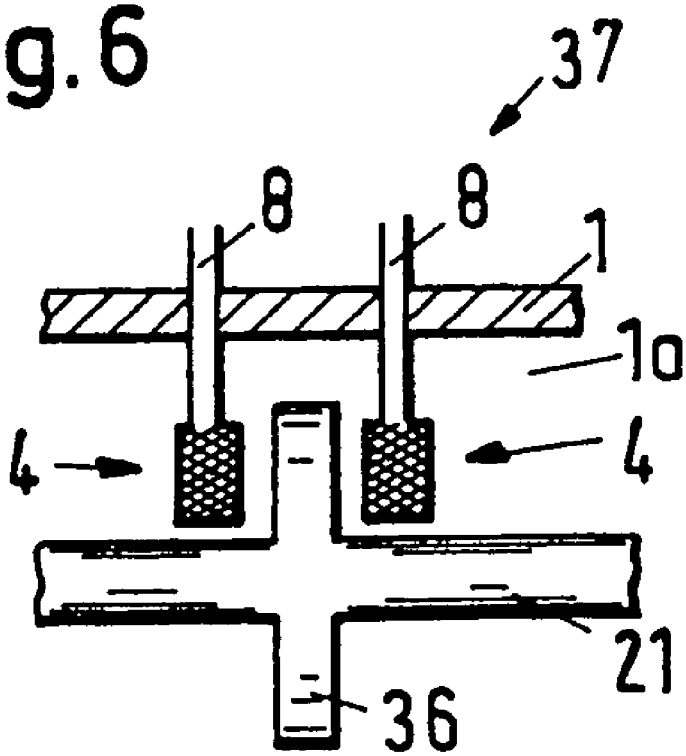
FIG. 6 a longitudinal section with a detailed aspect of an axial bearing.

FIG. 6 schematically shows an axial bearing with a disk 36 present in the pressure housing 1, the axial bearing being arranged between two electromagnets containing encapsulated apparatuses 4 in order to hold the rotatable shaft 21 in a predeterminable position. The encapsulated apparatus 4 is fully arranged within the pressure loaded space 1*a*, i.e. exposed to the process gas, with this encapsulated apparatus 4 also being connected via pressure reduction apparatuses 37 formed as connection lines in fluid-conducting manner with the space outside of the pressure housing 1.

The pressure reduction apparatuses 37 shown in the FIGS. 1 and 3 to 6 could naturally also be formed in the different embodiments shown in FIG. 2.

The method of the invention for the operation of a compression apparatus with a radial compressor 35 for the compression of a gas, an electric motor 31 for the driving of the radial compressor 35 and also an encapsulated apparatus 4 is carried out in that the pressure in the inner space 6 of the encapsulated apparatus 4 is influenced in such a way that it is kept, in all operating states of the compression apparatus, smaller or the same as the process pressure of the compression apparatus acting within the pressure housing 1.

The invention claimed is:

1. Compressor apparatus comprising a radial compressor (35) for the compression of a gas and also an electric motor (31) for driving the radial compressor (35) wherein the radial compressor (35) and the electric motor (31) are arranged in a pressure housing (1) which is provided with a gas inlet duct (2) and also a gas outlet duct (3) and also comprising an encapsulated apparatus (4) arranged in the pressure housing (1), the inner space of the encapsulated apparatus being fluid conductingly connected to a pressure reducing apparatus (37), wherein the pressure reducing apparatus includes an actuatable valve in order to controllably reduce the pressure in the inner space and a sensor far the determination of the pressure in the encapsulated apparatus and also a regulating apparatus, with the regulating apparatus detecting a sensor value, comparing this with a desired value and if required actuating the valve.

2. Compressor apparatus in accordance with claim 1, characterized in that the pressure reducing apparatus (37) consists at least of a connection line (8) to the space outside of the pressure housing (1).

3. Compressor apparatus in accordance with claim 1, characterized in that the pressure reduction apparatus (37) has a fluid conducting connection which opens into the atmosphere.

4. Compressor apparatus in accordance with claim 1, characterized in that a sensor (12) is additionally provided for the measurement of a process pressure and in that the sensor (12) is connected to the regulating apparatus (14).

5. Compressor apparatus in accordance with claim 1, characterized in that a sensor (26) is additionally provided for the measurement of an environmental pressure and in that the sensor (26) is connected to the regulating apparatus (14).

6. Compressor apparatus in accordance with claim 1, characterized in that the encapsulated apparatus (4) has a pressure stable support structure on which an encapsulation (5) lies.

7. Compressor apparatus in accordance with claim 1, characterized in that a stator (31*a*) of the electric motor (31) is arranged in the encapsulated apparatus (4).

8. Method for the operation of a compression apparatus including a radial compressor (35) for the compression of a gas and also an electric motor (31) for the driving of the radial compressor (35), wherein the radial compressor (35) and the electric motor (31) are arranged in a pressure housing (1), with the pressure housing (1) being provided with a gas inlet duct (2) and also a gas outlet duct (3) and with an encapsulated apparatus (4) with an inner space (6) being arranged within the pressure housing (1), wherein the pressure in the inner space (6) of the encapsulated apparatus (4) is influenced in such a way that it is kept to a smaller value than the process pressure of the compression apparatus applied within the pressure housing (1) in all operating states of the compression apparatus.

9. Method in accordance with claim 8 characterized in that the pressure in the inner space of the encapsulated apparatus (4) and also the process pressure is measured and the pressure in the inner space of the encapsulated apparatus (4) is regulated in a predeterminable relation to the process pressure by appropriate controlling of a valve (9).

10. Method in accordance with claim 8, characterized in that a flushing gas is supplied to the encapsulated apparatus (4) in order to clean its inner space from chemical contaminations.

* * * * *